United States Patent [19]

Maples

[11] Patent Number: 5,024,008

[45] Date of Patent: Jun. 18, 1991

[54] FOOTWEAR DEVICE FOR HUNTERS

[76] Inventor: D. Ray Maples, 3603 Chester La., Memphis, Tenn. 38119

[21] Appl. No.: 529,279

[22] Filed: May 29, 1990

[51] Int. Cl.[5] ..... A43B 23/24; A43B 5/18; A43B 7/12; A43B 1/10

[52] U.S. Cl. ..... 36/136; 36/1; 36/7.1 R; 36/7.3; 36/113

[58] Field of Search ..... 36/1, 2.6, 7.1 R, 7.3, 36/7.5, 9 R, 113, 132, 136

[56] References Cited

U.S. PATENT DOCUMENTS

| | | | |
|---|---|---|---|
| 1,447,586 | 3/1923 | Zucker | 36/7.3 |
| 1,780,407 | 11/1930 | Smith . | |
| 1,780,408 | 11/1930 | Smith . | |
| 2,904,901 | 9/1959 | Goldstein | 36/136 |
| 4,186,502 | 2/1980 | Foster | 36/136 |
| 4,302,899 | 12/1981 | DeHart | 43/1 |
| 4,609,245 | 9/1986 | Sakschek | 239/36 |
| 4,682,715 | 7/1987 | Reeves | 222/175 |
| 4,722,477 | 2/1988 | Floyd | 239/36 |
| 4,735,010 | 4/1988 | Grinarml | 43/1 |

FOREIGN PATENT DOCUMENTS

| | | | |
|---|---|---|---|
| 409657 | 11/1909 | France | 36/2.6 |

*Primary Examiner*—Jimmy G. Foster
*Assistant Examiner*—M. D. Patterson
*Attorney, Agent, or Firm*—Walker & McKenzie

[57] ABSTRACT

Footwear for use by hunters. The footwear includes a rubber overshoe to be worn over a boot worn by the hunter with the sole of the boot being covered by the overshoe whereby the boot will not come in contact with the ground as the hunter walks. A scent dispenser is provided which is attached to the overshoe for dispensing scent on the ground as the hunter walks. The scent dispenser is isolated from the boot so that the overshoe and dispenser may be removed from the boot and the boot worn without emitting scent. The rubber overshoe isolates the boot from the ground so that if the boot is contaminated by human scents, it will not be emitted to the ground.

7 Claims, 1 Drawing Sheet

FOOTWEAR DEVICE FOR HUNTERS

BACKGROUND OF THE INVENTION

1. Field of the Invention

The present invention relates, in general, to footwear devices for use by hunters.

2. Information Disclosure Statement

A preliminary patentability search conducted in Class 36, subclasses 98 and 136; Class 43, subclass 1; and Class 239, subclasses 36, 152 and 153 produced the following patents: Smith, U.S. Pat. No. 1,780,407; Smith, U.S. Pat. No. 1,780,408; Foster, U.S. Pay. No. 4,186,502; DeHart, U.S. Pat. No. 4,302,899; Sakschek, U.S. Pat. No. 4,609,245; Reeves, U.S. Pat. No. 4,682,715; Floyd, U.S. Pat. No. 4,722,477; and Grinarml, U.S. Pat. No. 4,735,010.

Smith U.S. Pat. No. 1,780,407 discloses an insect repeller adapted to be worn by a person for repelling attacks by mosquitoes, flies and other insect pests.

Smith U.S. Pat. No. 1,780,408 discloses a device for repelling mosquitoes, flies and other insect pests and which can be worn on different parts of one's clothing.

Foster discloses a scent dispensing means, as for example, for deer lure that has an absorbent pad adapted to be impregnated with scent and held within a pocket in a boot.

DeHart discloses an aromatic scent in a sponge for attracting animals.

Sakschek discloses a dispenser and method for dispensing odors such as naturally occurring odors, commonly for the purpose of either masking from wild animals the odor of a human in the vicinity, or for the purpose of attracting wild animals.

Reeves discloses a detachable shoe accessory for dispensing lure directly onto the ground for attracting animals or camouflaging one's own scent.

Floyd discloses a scented hunting strap including cooperating fastening members attached at each end of the flexible strap to allow for the flexible strap to be wrapped around an arm, leg, foot, etc. of the hunter and attached together.

Grinarml discloses a scent distributing device and method including a scent source and a tubular body which is connected to footwear.

It is well known that one of the most offensive sense that a deer has is its sense of smell. Also it is known that boots having leather soles leave a distinct scent trail as the hunter walks through the woods. Any deer encountering that trail will become alarmed and change course. One attempt to minimize this problem has been to provide the boots with rubber bottoms or to wear rubber boots since it is known that rubber absorbs virtually no scent whereby as the hunter walks through the woods, there is virtually no human scent trail. One disadvantage in wearing the rubber boots is that they are uncomfortable as compared with the regular hunting boots. Also, there is a problem with both the rubber boots and the regular hunting boots with rubber bottoms, as for example, when the hunter returns home with his boots on and with one or more of the animal attracting scents having been placed on the boot by the hunter to attract the animal being hunted, he doesn't want to walk into the house leaving the foul smelling odors as for example skunk, doe in heat, etc. to contaminate the house with such smells. Also in the meantime he has a problem of contaminating the vehicle in which he is riding to and from the hunting area.

SUMMARY OF THE INVENTION

The present invention is directed towards providing an improved footwear device for use by hunters which overcomes previous problems relating to human scents and scents for attracting the animal being hunted.

One of the objects of the present invention is to provide a footwear device for use by hunters which still retains the comfort of the leather boot but does away with the undesirable factor of leaving a scent trail of human odor, and includes an effective means for providing an attracting scent to the animals being hunted which may be quickly and easily removed from the boot whereby the boot may be worn in the house or the like without contaminating the house with the undesirable odor from the animal attracting scents.

A further object is to provide an effective means for applying the animal attracting scent to the ground and which can quickly and easily be changed.

The footwear device of the present invention in general comprises, in combination: rubber overshoe means for removably wearing over a boot worn by a hunter with a sole of the boot being covered by the overshoe means whereby the boot will not come in contact with the ground as the hunter walks; scent source means for dispensing scent on the ground as the hunter walks, said scent source means being attached to the overshoe means and removable with the overshoe means from the boot; and means isolating the scent source means from the boot whereby when the overshoe means with the scent source means is removed from the boot, the boot can be worn without emitting the animal attracting scent therefrom.

DESCRIPTION OF THE PREFERRED EMBODIMENT

The footwear device 11 of the present invention includes in general a rubber overshoe means 13 and an animal attracting scent source means 15 for emitting selected animal scents.

Figure 1:
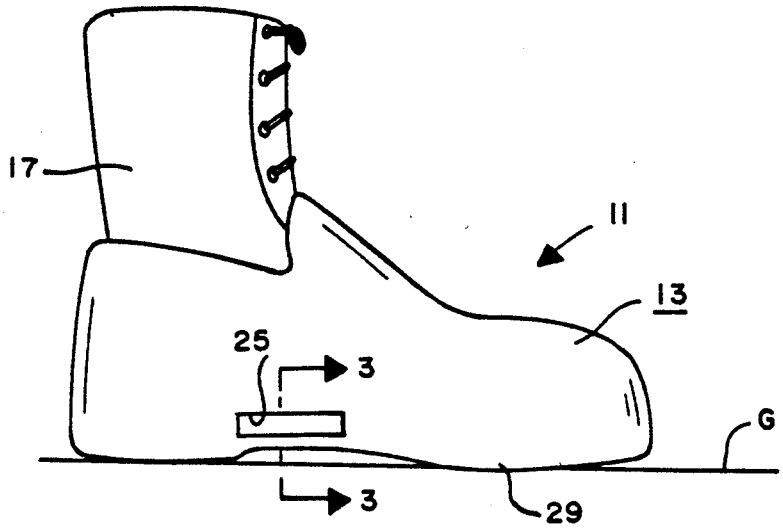
FIG. 1 is a side elevational view of the footwear device shown as being worn over a boot.

Rubber overshoe means 13 is generally similar to a rubber overshoe well known to those skilled in the art which covers the lower portion of the footwear of the wearer, such as the boot 17 shown in FIG. 1 which isolates the boot including the sole 19 thereof from the surface or ground G upon which the hunter is walking.

Rubber overshoe means 13 is formed from natural or synthetic rubber material well known to those skilled in the art. Rubber overshoe means 13 includes a pocket 21 formed therein, as by being integrally molded in with the remaining portions of the overshoe means, as by molding methods well known to those skilled in the art.

Pocket 21 includes a cavity 23 for receiving scent source means 15, and includes a mouth 25 establishing an entrance to cavity 23 from the outside of overshoe means 13. Cavity 23 preferably extends transversely across overshoe means 13 in the instep thereof from mouth 25 to a wall 27 formed in the overshoe means 13. Mouth 25 preferably is on the inside or inboard side of the overshoe means and wall 27 is on the outside or outboard side of the overshoe means. In addition to wall 27, cavity 23 is also defined in part by a part of bottom portion 29 of overshoe means 13. In addition, cavity 23 is also defined in part by wall 31 above scent source means 15.

Wall 31 is integrally and sealingly attached along the opposite side edges 33, 35 thereof respectively to the opposite side walls 37, 39 of overshoe means 13 to establish means 41 isolating scent source means 15 from boot 17.

Scent source means 15 preferably includes a block or pad 43 of a material which is preferably sponge, but may be made of felt, that is impregnated with animal lure, preferably in the form of a liquid scent, known to those skilled in the art, such as those which are commercially available. Pad 43 is preferably of the same shape and size as cavity 23 so that friction keeps block 43 in cavity 23. If desired, a lip 45 may be provided in overshoe means 13 across the bottom of mouth 25 to assist in keeping block 43 in cavity 23.

Figure 2:
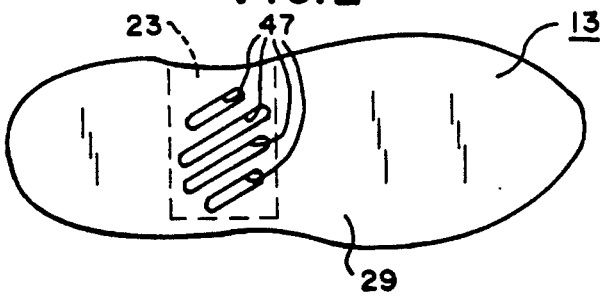
FIG. 2 is a bottom view of the footwear device shown in FIG. 1.
Figure 3:
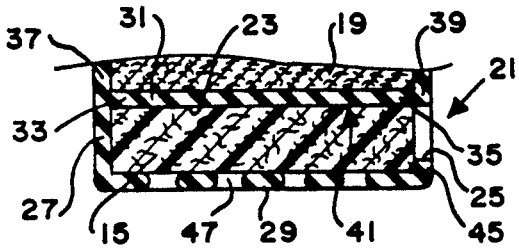
FIG. 3 is an enlarged sectional view taken as on the line 3—3 of FIG. 1.
Figure 4:
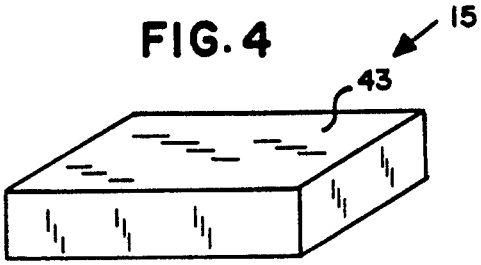
FIG. 4 is a perspective view of the scent source means.

Slots 47, which are preferably at an angle relative to the longitudinal axis of overshoe means 13, extend from cavity 23 and through bottom portion 29 so that animal attracting scent from scent source means 15 may be emitted onto the ground when footwear device 11 is in use. There are preferably a plurality of slots 47, which are parallel to one another as best seen in FIG. 2.

In the use of footwear device 11, rubber overshoe means 13 is placed on boot 17 in the usual manner that an overshoe is placed over a shoe as is now known to those skilled in the art. The pad 43 is placed into cavity 23 through mouth 25, and then the liquid scent or animal attracting lure may be poured into block 43 through mouth 25 to impregnate pad 43 with the scent and to provide animal scent source means 15, whereby animal attracting scent is emitted through the slots 47 as the hunter walks over the ground S. More of the liquid scent may be applied to pad 43 as the need arises, and when the pad 43 wears out, a new pad may be used to replace the old pad.

It will be understood that the footwear device 11 has the advantage of the rubber overshoe means 13 isolating the boot from the ground G so that human scents which are picked up by the leather of the boot 17 are not emitted to the ground G, which would otherwise warn the animal being hunted of the presence of the hunter. Also the comfort of the leather boot 17 may be enjoyed, as opposed to rubber boots, and without warning the animals of the hunter's presence by the scent of the leather. In addition, it will be understood that the hunter may remove the overshoe means 13 at the appropriate time, as for example before getting into his vehicle or before going into the house, and can place the rubber overshoe means 13 in a ziplock bag, leaving the boot 17 free from an foul smelling animal scents.

Although the present invention has been described and illustrated with respect to a preferred embodiment and a preferred use thereof, it is not to be so limited since modifications and changes can be made therein which are within the full intended scope of the invention.

I claim:

1. A footwear device for use by hunters comprising, in combination:

a) rubber overshoe means for removably wearing over a boot worn by a hunter with the sole of the boot being covered by said overshoe means whereby the boot will not come in contact with the ground as the hunter walks;

b) scent source means for dispensing animal attracting scent onto the ground as the hunter walks, said scent source means being attached to said overshoe means and removable with said overshoe means from the boot; and, c) means isolating said scent source means from the boot whereby when said overshoe means with said scent source means is removed from the boot, the boot can be worn without emitting the animal attracting scent therefrom;

said overshoe means including a pocket formed therein, said pocket including a cavity for receiving said scent source means and a mouth establishing an entrance to said cavity from the outside of said overshoe means through which said scent means may be moved from and to said cavity, a bottom portion of said overshoe for contacting the ground as the hunter walks, and at least one slot extending from said cavity and through said bottom portion of said overshoe means through which scent from said scent source means may be emitted to the ground when said overshoe means is disposed on said boot.

2. The combination of claim 1 in which said scent source means includes a sponge and animal lure impregnated therein.

3. The combination of claim 2 in which said overshoe means includes lip means adjacent said mouth for removably holding said sponge in said cavity against accidental removal thereof.

4. The combination of claim 3 in which is provided more than one of said slots extending from said cavity and through said bottom portion of said overshoe means.

5. The combination with a boot having a leather sole of a footwear device for a hunter; said footwear device comprising:

a) a rubber overshoe removably disposed on said boot and covering said sole of said boot whereby said boot sole will not come in contact with the ground as the hunter walks;

b) scent source means for dispensing animal attracting scent on the ground as the hunter walks, said scent source means being attached to said overshoe and removable with said overshoe from said boot; and, c) means isolating said scent source means from said boot whereby when said overshoe with said scent source means is removed from said boot, said boot can be worn without emitting the animal attracting scent therefrom;

said overshoe including a pocket formed therein, said pocket including a cavity, a mouth establishing an entrance to said cavity from the outside of said overshoe, a bottom portion of said overshoe for contacting the ground as the hunter walks, and at least one slot extending from said cavity and through said bottom portion of said overshoe, and in which said scent source means is disposed in said cavity for emitting the animal attracting scent onto the ground through said slot when said overshoe is disposed on said boot.

6. The combination of claim 5 in which said scent source means includes a sponge impregnated with animal lure.

7. A footwear device for use by hunters comprising, in combination:

a) rubber overshoe means for removably wearing over a boot of the type having a leather sole worn by a hunter with the sole of the boot being covered by said overshoe means whereby the boot sole will not come in contact with the ground as the hunter walks, said overshoe means including a pocket formed therein, said pocket including a cavity, a mouth establishing an entrance to said cavity from the outside of said overshoe means, a lip adjacent said mouth and extending across a portion of said mouth, a bottom portion of said overshoe means for contacting the ground as the hunter walks, and a plurality of parallel slots extending from said cavity and through said bottom portion of said overshoe means;

b) scent source means for dispensing animal attracting scent onto the ground as the hunter walks, said scent source means including pad means impregnated with animal lure, said pad means being disposed in said cavity and being removably held therein by said lip against accidental removal from said cavity; and c) means isolating said scent source means from the boot whereby when said overshoe means with said scent source means is removed from the boot, the boot can be worn without emitting the animal attracting scent therefrom, said means isolating said scent source means from said boot including a wall establishing the upper surface of said cavity.

* * * * *